US009819109B2

(12) United States Patent
Duan et al.

(10) Patent No.: US 9,819,109 B2
(45) Date of Patent: Nov. 14, 2017

(54) PLUG TERMINAL

(71) Applicant: ADVANCED-CONNECTEK INC., New Taipei (TW)

(72) Inventors: Shu-Lin Duan, New Taipei (TW); Wei Wan, New Taipei (TW); Xiao-Juan Qi, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 15/347,960

(22) Filed: Nov. 10, 2016

(65) Prior Publication Data

US 2017/0133781 A1 May 11, 2017

(30) Foreign Application Priority Data

Nov. 10, 2015 (CN) ..... 2015 2 0889203 U

(51) Int. Cl.
*H01R 13/11* (2006.01)
*H01R 4/02* (2006.01)
*H01R 12/58* (2011.01)

(52) U.S. Cl.
CPC ..... *H01R 13/112* (2013.01); *H01R 4/028* (2013.01); *H01R 12/58* (2013.01)

(58) Field of Classification Search
CPC ..... H01R 13/112; H01R 13/113; H01R 13/11
USPC ..... 439/856, 857, 78, 83
See application file for complete search history.

(56) References Cited

U.S. PATENT DOCUMENTS 3,199,066 A * 8/1965 Eledge ..... H01R 12/716 439/636
3,601,775 A * 8/1971 Longenecker ..... H01R 12/721 439/636
5,004,426 A * 4/1991 Barnett ..... H01R 13/112 439/82
5,011,440 A * 4/1991 Lee ..... H01R 4/4818 439/654
5,376,012 A * 12/1994 Clark ..... H01R 13/111 439/80
6,171,126 B1 * 1/2001 Wu ..... H01R 11/282 439/224
6,461,183 B1 * 10/2002 Ohkita ..... H01R 12/57 439/259
8,047,857 B1 * 11/2011 Lu ..... H01R 12/714 439/500

(Continued)

*Primary Examiner* — Gary Paumen
(74) *Attorney, Agent, or Firm* — Muncy, Geissler, Olds & Lowe, P.C.

(57) ABSTRACT

A plug terminal includes a main body, a contact portion, and a connecting portion. The contact portion is extending outwardly from the main body, so that the contact portion and the main body form a clamping structure. The contact portion includes a first spring arm and a second spring arm. An inner side of the first spring arm includes adjacent first and second contact protrusions. The second spring arm faces the first spring arm. An inner side of the second spring arm includes adjacent third and fourth contact protrusions. The third contact protrusion faces the first contact protrusion, and the fourth contact protrusion faces the second contact protrusion. Accordingly, when a plug connector is mated with a receptacle connector, the contact area between the connectors can be increased by the plural contact protrusions to guarantee the stability of the electrical contact between plug terminals and receptacle terminals.

12 Claims, 4 Drawing Sheets

(56) References Cited

U.S. PATENT DOCUMENTS

| | | | | |
|---|---|---|---|---|
| 8,998,657 | B1 * | 4/2015 | Von Eckroth | H01R 13/114<br>439/810 |
| 9,431,721 | B2 * | 8/2016 | Wimmer | H01R 4/2416 |
| 2004/0097141 | A1 * | 5/2004 | Belopolsky | H01R 12/58<br>439/857 |
| 2005/0245144 | A1 * | 11/2005 | Hegel | H01R 13/112<br>439/857 |
| 2007/0037416 | A1 * | 2/2007 | Peng | H01R 12/7052<br>439/74 |
| 2013/0244507 | A1 * | 9/2013 | Neumann | H01R 12/721<br>439/828 |

* cited by examiner

PLUG TERMINAL

CROSS-REFERENCE TO RELATED APPLICATION

This non-provisional application claims priority under 35 U.S.C. §119(a) to Patent Application No. 201520889203.0 filed in China, P.R.C. on Nov. 10, 2015, the entire contents of which are hereby incorporated by reference.

FIELD OF THE INVENTION

The instant disclosure relates to a terminal, and more particular to a plug terminal for electrical plug connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. Consequently, faster serial bus interfaces such as USB 3.1, are developed, which may provide a higher transmission rate so as to satisfy the need of a variety devices.

An existing USB type-C electrical plug connector includes upper and lower plug terminals assembled on a plastic body, an outer metallic shell enclosing the plastic body, etc. Tail portions of the terminals are combined with cables by soldering, so that the USB Type-C electrical plug connector can be served as a transmission wire and the upper and lower terminals are provided for signal and power transmission along with the cables.

Please refer to FIG. 1, illustrating a perspective view of a conventional clamp-type plug terminal A. The terminal is a terminal for USB Type-C electrical plug connector and includes a positioning portion A1 adapted to be assembled with a plastic body of the connector, contact portions A2 at two sides of the positioning portion A1, and a soldering portion A3 manufactured by bending procedures. The contact portion A2 of the clamp-type plug terminal A includes a single contact point A21, and the contact portion A2 is in contact with a receptacle terminal in a point-contact manner, i.e., by the contact point A21. Hence, when a dust or particles are on the receptacle terminal, the contact point A21 may not be in contact with the receptacle terminal sufficiently due to the existence of the dust or article. As a result, the contact between the plug terminal and the receptacle terminal is not stable and results in bad electrical signal transmission.

SUMMARY OF THE INVENTION

How to solve the aforementioned problem is an issue.

In view of this, an embodiment of the instant disclosure provides a plug terminal. The plug terminal comprises a main body, a contact portion, and a connecting portion. The contact portion is extending outwardly from one of two ends of the main body, so that the contact portion and the main body form a clamping structure. The contact portion comprises a first spring arm, a second spring arm, and a clamping region. An inner side of the first spring arm comprises a first contact protrusion and a second contact protrusion near the first contact protrusion. The second spring arm faces the first spring arm. An inner side of the second spring arm comprises a third contact protrusion and a fourth contact protrusion near the third contact protrusion. The third contact protrusion faces the first contact protrusion, and the fourth contact protrusion faces the second contact protrusion. The clamping region is between the first spring arm and the second spring arm. The connecting portion is extending outwardly form the other end of the main body.

In one embodiment, the first spring arm and the second spring arm are inclinedly and outwardly extending from two sides of the main body, respectively. A distance between the first spring arm and the second spring arm is gradually reduced from root portions to end portions thereof. Moreover, a distance between the first contact protrusion and the third contact protrusion is less than a distance between the second contact protrusion and the fourth contact protrusion. Furthermore, a width of the clamping region between the first contact protrusion and the third contact protrusion is less than a width of the clamping region between the second contact protrusion and the fourth contact protrusion.

In one embodiment, the contact portion comprises a first guiding portion and a second guiding portion. The first guiding portion is inclinedly and outwardly extending from an end of the first spring arm. The second guiding portion is inclinedly and outwardly extending from an end of the second spring arm.

In one embodiment, the main body comprises a body portion and a plurality of engaging portions respectively protruding from two sides of the body portion. In addition, the main body comprises a plurality of recesses on two sides of the body portion and near the engaging portions, respectively.

In one embodiment, the connecting portion comprises two legs symmetrically and respectively extending from two sides of the main body. In addition, the connecting portion comprises two blocking portions. Each of the blocking portions is formed on an outer periphery of the corresponding leg and near the main body. Furthermore, the connecting portion comprises a plurality of storage recesses each on an inner side of the corresponding leg.

According to some embodiments of the instant disclosure, when a plug connector is mated with a receptacle connector, the contact area between the plug connector and the receptacle connector can be increased by the design of the plural number of contact protrusions to guarantee the stability of the electrical contact between plug terminals and receptacle terminals and to meet the specification for large current transmission. Moreover, under this circumstance in which each of the spring arms has a plurality of contact protrusions, when a dust or particles are on the receptacle terminal, the first contact protrusion and the third contact protrusion which will be the first group of contact protrusions to be in contact with the receptacle terminal can sweep the dust or particles from the receptacle terminal. Hence, the second contact protrusion and the fourth contact protrusion which will be the second group of contact protrusions to be in contact with the receptacle terminal can be firmly in contact with the receptacle terminal. In addition, the plug terminal is formed integrally by stamping and blanking techniques. Therefore, the structural strength of the terminal can be improved, the terminal can be prevented from deforming upon the terminal is assembling to a plastic body of a plug connector, and the terminal can be provided for transmitting signals stably. Furthermore, the terminal can be manufactured simply, and the cost for manufacturing the terminal can be reduced.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
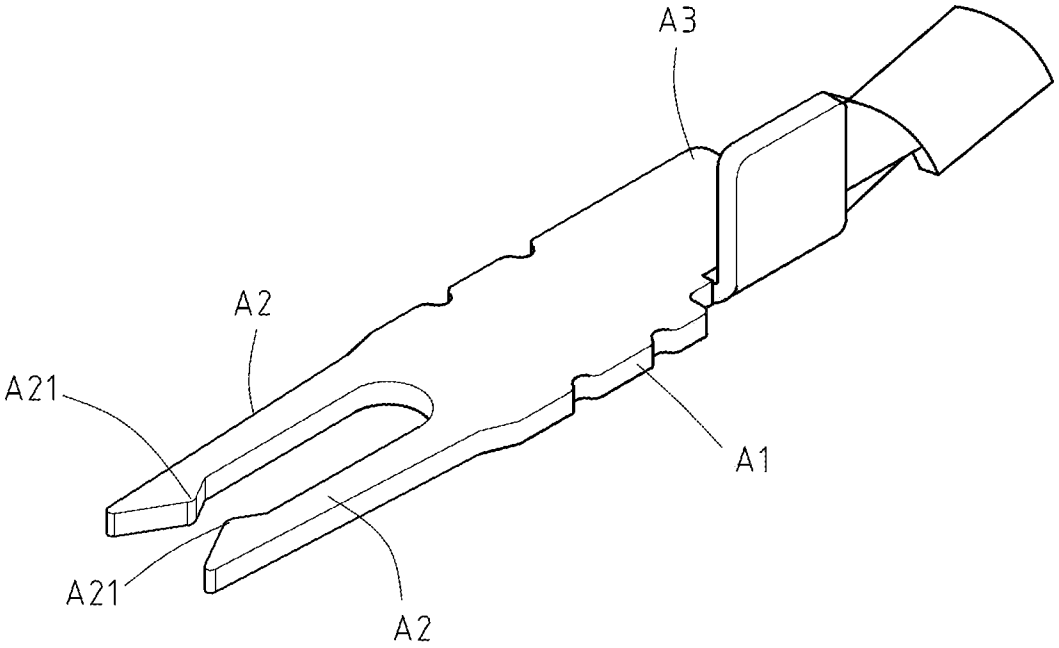
FIG.1 (PRIOR ART)
FIG. 1 illustrates a perspective view of a conventional terminal.
Figure 2:
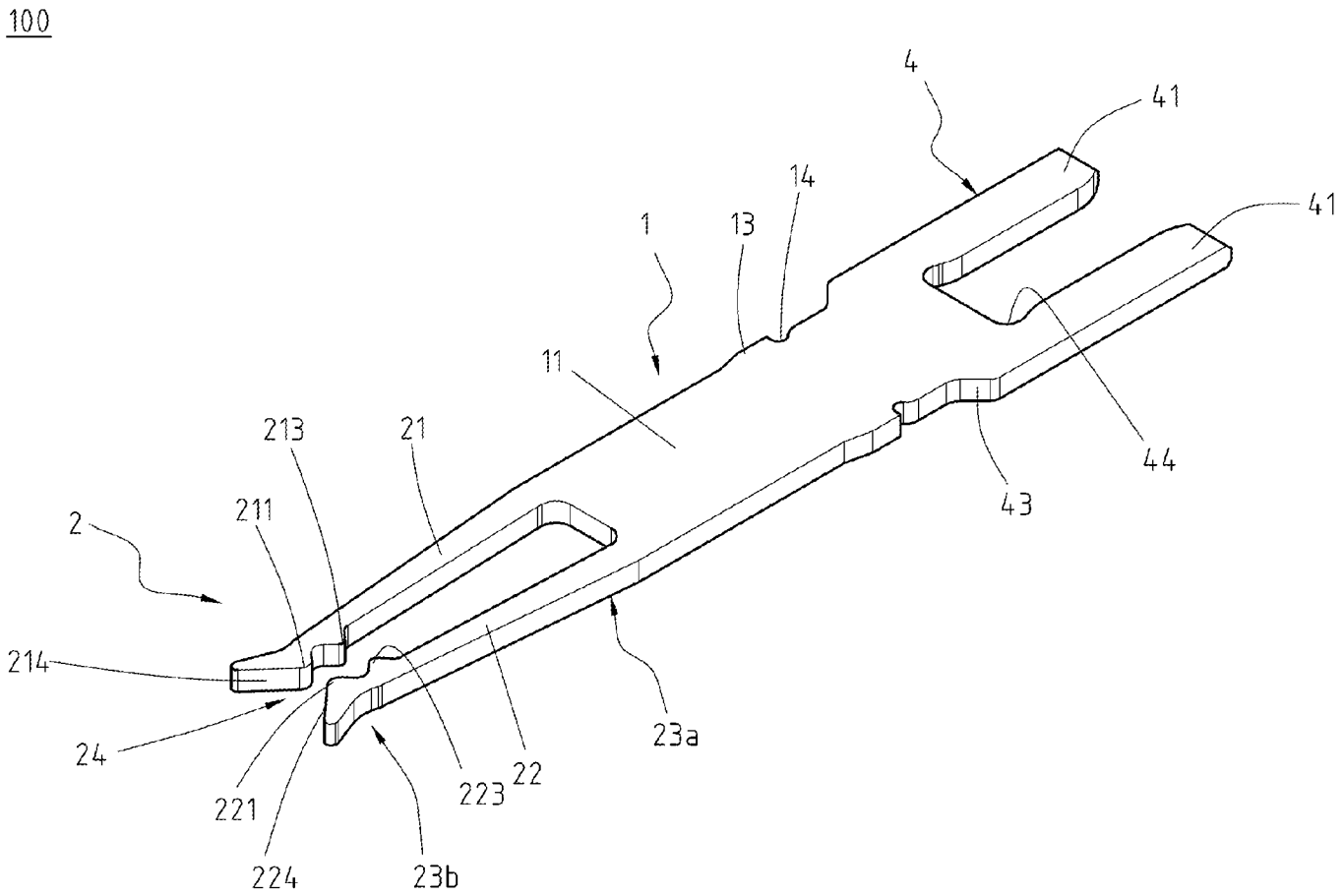
FIG. 2 illustrates a perspective view of a plug terminal according to an exemplary embodiment of the instant disclosure.
Figure 3:
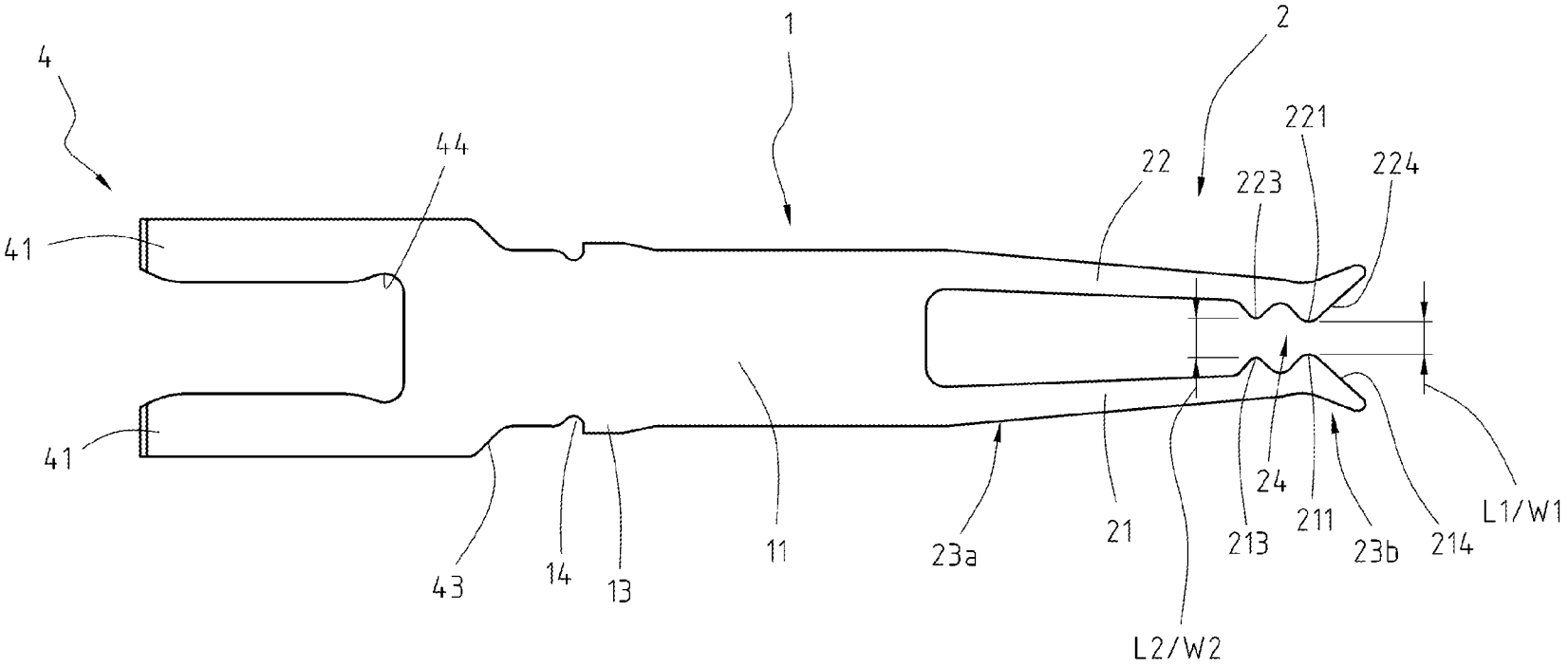
FIG. 3 illustrates a side view of the plug terminal.
Figure 4:
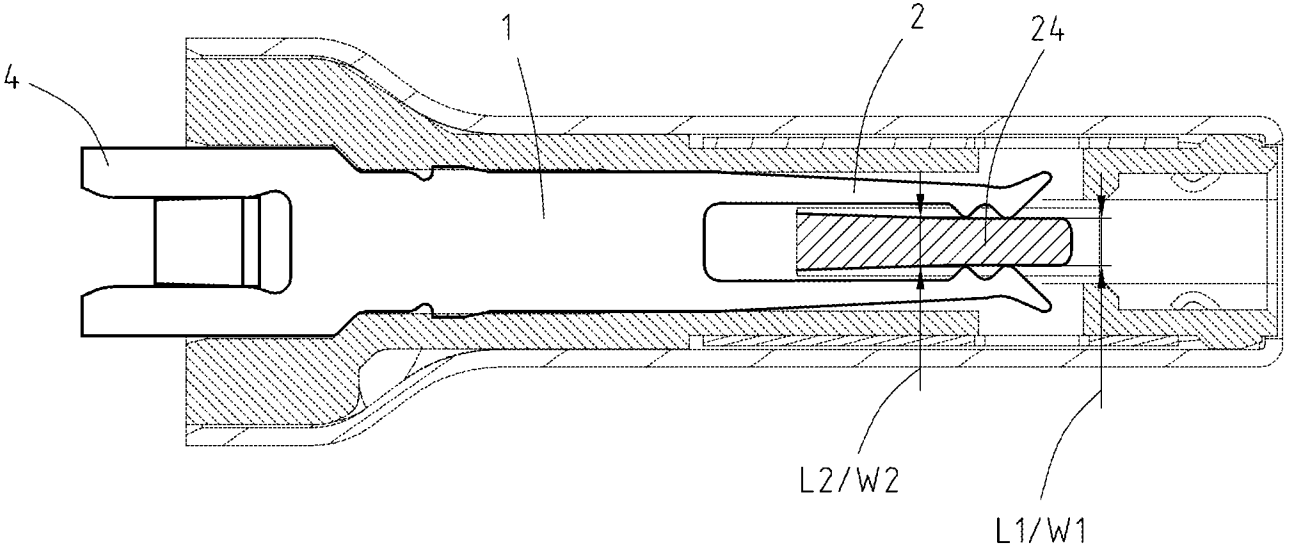
FIG. 4 illustrates a side operational view of the plug terminal.

Please refer to FIGS. 2 to 4, illustrating a plug terminal according to an exemplary embodiment of the instant disclosure. FIG. 2 illustrates a perspective view of the plug terminal. FIG. 3 illustrates a side view of the plug terminal. FIG. 4 illustrates a side operational view of the plug terminal. In this embodiment, a single plug terminal 100 is provided and discussed. The plug terminal 100 may be served as a USB Type-C terminal with multiple contacts. The plug terminal 100 is formed integrally by stamping and blanking techniques. Therefore, the structural strength of the terminal can be improved, the terminal can be prevented from deforming upon the terminal is assembling to a plastic body of a plug connector, and the terminal can be provided for transmitting signals stably. Furthermore, the terminal can be manufactured simply, and the cost for manufacturing the terminal can be reduced. When several plug terminals 100 are assembled to a plastic body of a plug connector, the plug terminals 100 may be arranged in a line and then the line assembly of the plug terminals 100 is assembled to the plastic body. Hence, the time for manufacturing the plug connector product is shortened and the cost for manufacturing the plug connector product is reduced. In this embodiment, the plug terminal 100 comprises a main body 1, a contact portion 2, and a connecting portion 4. The plug terminal 100 may be assembled with a plastic body and an outer shell for manufacturing a plug connector.

Please refer to FIGS. 2 to 4. The main body 1 is a thin, elongated, and rectangular sheet. The main body 1 comprises a body portion 11 and a plurality of engaging portions 13 respectively protruding from two sides of the body portion 11. When the main body 1 is assembled with the plastic body, the main body 1 is assembled with the plastic body by riveting. In detail, the main body 1 is riveted into the plastic body, and the engaging portions 13 are held in the plastic body to position the main body 1 with the plastic body. In addition, in this embodiment, the main body 1 further comprises a plurality of recesses 14 at two sides of the body portion 11 and near the engaging portions 13, respectively. When the engaging portions 13 are engaged in an inner wall of the plastic body, the inner wall of the plastic body will be rubbed against the engaging portions 13 to produce waste materials, and the waste materials can be received in the recesses 14.

Please refer to FIGS. 2 to 4. The contact portion 2 is extending outwardly from one of two ends of the main body 1, so that the contact portion 2 and the main body 1 together form a clamping structure. The contact portion 2 comprises a first spring arm 21, a second spring arm 22, and a clamping region 24.

Please refer to FIGS. 2 to 4. In this embodiment, an inner side of the first spring arm 21 comprises a first contact protrusion 211 and a second contact protrusion 213 near the first contact protrusion 211; namely, a single first spring arm 21 has two contact points. In addition, the first contact protrusion 211 and the second contact protrusion 213 are near each other to form a wavy structure. In one embodiment, the inner side of the first spring arm 21 may have three or more adjacent contact protrusion, namely, a single first spring arm 21 may have three or more contact points to increase the contact area between the plug terminal 100 and a mating receptacle terminal.

Please refer to FIGS. 2 to 4. In this embodiment, an inner side of the second spring arm 22 comprises a third contact protrusion 221 and a fourth contact protrusion 223; namely, a single second spring arm 22 has two contact points. In addition, the third contact protrusion 221 and the fourth contact protrusion 223 are near each other to form a wavy structure. The third contact protrusion 221 faces the first contact protrusion 211. The third contact protrusion 221 and the first contact protrusion 211 are respectively in contact with two corresponding points of an upper surface and a lower surface of a receptacle terminal in which the two points are aligned along a same axial line of the receptacle terminal. The fourth contact protrusion 223 faces the second contact protrusion 213. The fourth contact protrusion 223 and the second contact protrusion 213 are respectively in contact with two corresponding points of an upper surface and a lower surface of a receptacle terminal. In one embodiment, the second spring arm 22 may further comprise three or more adjacent contact protrusions, namely, a single second spring arm 22 may have three or more contact points to increase the contact area between the plug terminal 100 and a mating receptacle terminal.

The first spring arm 21 and the second spring arm 22 each have a plurality of contact protrusions. That is, the first spring arm 21 has the first contact protrusion 211 and the second contact protrusion 213, and the second spring arm 22 has the third contact protrusion 221 and the fourth contact protrusion 223. When a plug connector is mated with a receptacle connector, the contact area between the plug connector and the receptacle connector can be increased by the design of the plural number of contact protrusions to guarantee the stability of the electrical contact between plug terminals and receptacle terminals and to meet the specification for large current transmission. Moreover, under this circumstance in which each of the spring arms has a plurality of contact protrusions, when a dust or particles are on the receptacle terminal, the first contact protrusion 211 and the third contact protrusion 221 which will be the first group of contact protrusions to be in contact with the receptacle terminal can sweep the dust or particles from the receptacle terminal. Hence, the second contact protrusion 213 and the fourth contact protrusion 223 which will be the second group of contact protrusions to be in contact with the receptacle terminal can be firmly in contact with the receptacle terminal.

Please refer to FIGS. 2 to 4. In this embodiment, the first spring arm 21 and the second spring arm 22 are inclinedly and outwardly extending from two sides of the main body 1, respectively, and a distance between the first spring arm 21 and the second spring arm 22 gradually reduce from root portions 23*a* thereof to end portions 23*b* thereof. In other words, a distance L1 between the first contact protrusion 211 and the third contact protrusion 221 is less than a distance L2 between the second contact protrusion 213 and the fourth contact protrusion 223. The first spring arm 21 and the second spring arm 22 are symmetrical with each other. In addition, a clamping region 24 is formed between the first spring arm 21 and the second spring arm 22. In this embodiment, a width W1 of the clamping region 24 between the first contact protrusion 211 and the third contact protrusion 221 is less than a width W2 of the clamping region 24 between the second contact protrusion 213 and the fourth contact protrusion 223. When the plug connector is mated with the receptacle connector, the first spring arm 21 and the second spring arm 22 are in contact with a corresponding receptacle terminal of the receptacle connector, and the first spring arm 21 and the second spring arm 22 are laterally swingable. Hence, the clamping force of the plug terminal can be improved.

In the foregoing embodiment, the first spring arm 21 and the second spring arm 22 are inclinedly and outwardly extending from two sides of the main body 1, but embodiments are not limited thereto. In one embodiment, the first spring arm 21 and the second spring arm 22 may be straightly and outwardly extending from two sides of the main body 1 so as to clamp and contact the receptacle terminal. That is, a distance L1 between the first contact protrusion 211 and the third contact protrusion 221 is equal to a distance L2 between the second contact protrusion 213 and the fourth contact protrusion 223. Accordingly, the first spring arm 21 and the second spring arm 22 clamp the corresponding receptacle terminal of the receptacle connector when the plug connector is mated with the receptacle connector. Moreover, the first contact protrusion 211 and the second contact protrusion 213 are together in contact with one of two opposite surfaces of the receptacle terminal, and the third contact protrusion 221 and the fourth contact protrusion 223 are together in contact with the other surface of the receptacle terminal.

Please refer to FIGS. 2 to 4. The connecting portion 4 is outwardly extending from the other end of the main body 1. In this embodiment, the connecting portion 4 comprises two legs 41 in symmetrical configuration, i.e., in a mirrored symmetry. The legs 41 are extending from two sides of the main body 1. The legs 41 and the main body 1 form a U shape structure. An outer portion of an inner side of each of the legs 41 has a chamfered structure for guiding a circuit board upon the circuit board is inserted between two legs 41. Hence, the legs 41 can be in contact with and conducted with the contacts on the upper and lower surfaces of the circuit board.

Please refer to FIGS. 2 to 4. The connecting portion 4 further comprises two blocking portions 43. Each of the blocking portions 43 is formed on an outer periphery of the corresponding leg 41 and near the main body 1. The two blocking portions 43 are in symmetrical configuration and perform a positioning function. When the main body 1 is riveted in the plastic body, the two blocking portions 43 are engaged with the inner wall of the plastic body for positioning the plug terminal 100 with the plastic body.

Please refer to FIGS. 2 to 4. The connecting portion 4 further comprises a plurality of storage recesses 44 each on an inner side of the corresponding leg 41. When a solder of the circuit board is soldered with the connecting portion 4, surplus pastes can be flowed into and stored in the storage recesses 44. Moreover, an outline of the storage recess 14 is a continuous curve. In addition, the storage recesses 44 are at the corners connecting the main body 1 and the inner side of the legs 41, and the storage recesses 44 are caved from the inner side of the legs 41, respectively.

Please refer to FIGS. 2 to 4. In this embodiment, the contact portion 2 further comprises a first guiding portion 214 and a second guiding portion 224. The first guiding portion 214 is inclinedly and outwardly extending from an end of the first spring arm 21. The second guiding portion 224 is inclinedly and outwardly extending from an end of the second spring arm 22. When the plug connector is mated with the receptacle connector, the first guiding portion 214 and the second guiding portion 224 provide a guiding function to facilitate the mating between the plug connector and the receptacle connector.

According to some embodiments of the instant disclosure, when a plug connector is mated with a receptacle connector, the contact area between the plug connector and the receptacle connector can be increased by the design of the plural number of contact protrusions to guarantee the stability of the electrical contact between plug terminals and receptacle terminals and to meet the specification for large current transmission. Moreover, under this circumstance in which each of the spring arms has a plurality of contact protrusions, when a dust or particles are on the receptacle terminal, the first contact protrusion and the third contact protrusion which will be the first group of contact protrusions to be in contact with the receptacle terminal can sweep the dust or article from the receptacle terminal. Hence, the second contact protrusion and the fourth contact protrusion which will be the second group of contact protrusions to be in contact with the receptacle terminal can be firmly in contact with the receptacle terminal. In addition, the plug terminal is formed integrally by stamping and blanking techniques. Therefore, the structural strength of the terminal can be improved, the terminal can be prevented from deforming upon the terminal is assembling to a plastic body of a plug connector, and the terminal can be provided for transmitting signals stably. Furthermore, the terminal can be manufactured simply, and the cost for manufacturing the terminal can be reduced.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A plug terminal, comprising:

a main body;

a contact portion extending outwardly from one of two ends of the main body, so that the contact portion and the main body together form a clamping structure, wherein the contact portion comprises:

a first spring arm, wherein an inner side of the first spring arm comprises a first contact protrusion and a second contact protrusion near the first contact protrusion;

a second spring arm facing the first spring arm, wherein an inner side of the second spring arm comprises a third contact protrusion and a fourth contact protrusion near the third contact protrusion, the third contact protrusion faces the first contact protrusion, the fourth contact protrusion faces the second contact protrusion; and a clamping region between the first spring arm and the second spring arm; and a connecting portion extending outwardly from the other end of the main body and comprising two legs symmetrically and respectively extending from two sides of the main body, wherein the connecting portion comprises a plurality of storage recesses each on an inner side of the corresponding leg.

2. The plug terminal according to claim 1, wherein the first spring arm and the second spring arm are inclinedly and outwardly extending from two sides of the main body, respectively, a distance between the first spring arm and the second spring atm gradually is reduced from root portions to end portions thereof.

3. The plug terminal according to claim 1, wherein a distance between the first contact protrusion and the third contact protrusion is less than a distance between the second contact protrusion and the fourth contact protrusion.

4. The plug terminal according to claim 3, wherein a width of the clamping region between the first contact protrusion and the third contact protrusion is less than a width of the clamping region between the second contact protrusion and the fourth contact protrusion.

5. The plug terminal according to claim 2, wherein a distance between the first contact protrusion and the third contact protrusion is less than a distance between the second contact protrusion and the fourth contact protrusion.

6. The plug terminal according to claim 5, wherein a width of the clamping region between the first contact protrusion and the third contact protrusion is less than a width of the clamping region between the second contact protrusion and the fourth contact protrusion.

7. The plug terminal according to claim 1, wherein the contact portion comprises a first guiding portion and a second guiding portion, the first guiding portion is inclinedly and outwardly extending from an end of the first spring arm, the second guiding portion is inclinedly and outwardly extending from an end of the second spring arm.

8. The plug terminal according to claim 1, wherein the main body comprises a body portion and a plurality of engaging portions respectively protruding from two sides of the body portion.

9. The plug terminal according to claim 8, wherein the main body comprises a plurality of recesses on two sides of the body portion and near the engaging portions, respectively.

10. The plug terminal according to claim 1, wherein the connecting portion comprises two blocking portions, each of the blocking portions is formed on an outer periphery of the corresponding leg and near the main body.

11. The plug terminal according to claim 1, wherein the storage recesses are at the corners connecting the main body and the inner side of the legs, and the storage recesses are respectively caved from the inner side of the legs.

12. The plug terminal according to claim 1, wherein an outline of each of the storage recess is a continuous curve.

* * * * *